US007878033B2

(12) United States Patent
Fawcett et al.

(10) Patent No.: US 7,878,033 B2
(45) **Date of Patent: *Feb. 1, 2011**

(54) BOTTLE SECURITY DEVICE

(75) Inventors: Christopher J. Fawcett, Charlotte, NC (US); Ronald M. Marsilio, Lake Wiley, SC (US)

(73) Assignee: Checkpoint Systems, Inc., Philadelphia, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/634,840

(22) Filed: Dec. 10, 2009

(65) Prior Publication Data

US 2010/0089105 A1 Apr. 15, 2010

Related U.S. Application Data

(63) Continuation of application No. 11/436,730, filed on May 17, 2006, now Pat. No. 7,650,768.

(60) Provisional application No. 60/758,686, filed on Jan. 13, 2006.

(51) Int. Cl.
*E05B 73/00* (2006.01)

(52) U.S. Cl. ..... 70/58; 70/15; 70/57.1; 292/256.6; 215/207; 340/572.9

(58) Field of Classification Search ..... 70/15, 70/16, 18, 57, 57.1, 58, 59, 61, DIG. 9; 340/542, 340/571, 572.1, 572.8, 572.9; 215/201, 207, 215/212; 24/456, 704.1; 292/256, 256.6
See application file for complete search history.

(56) References Cited

U.S. PATENT DOCUMENTS 2,125,052 A 7/1938 Ranson
3,214,808 A 11/1965 Litwin
3,712,655 A 1/1973 Fuehrer
3,874,034 A 4/1975 Clayton
4,059,299 A 11/1977 Huntley
4,128,220 A 12/1978 McNeel
4,196,424 A 4/1980 Williamson
4,287,644 A 9/1981 Durand
4,502,305 A 3/1985 Bakker
4,506,415 A 3/1985 Swift
4,580,319 A 4/1986 Paradis
4,708,306 A 11/1987 Mitomi
4,929,006 A 5/1990 Tsay
4,958,411 A 9/1990 Stanley
5,079,540 A 1/1992 Narlow et al.
5,123,686 A 6/1992 Wenk
5,193,254 A 3/1993 Geisinger (Continued)

*Primary Examiner*—Suzanne Dino Barrett
*Assistant Examiner*—Christopher Boswell
(74) *Attorney, Agent, or Firm*—Sand & Sebolt

(57) ABSTRACT

A security device includes a housing and a strap which extends from the housing and loops around a bottle neck or other item to secure the device thereto. A locking mechanism lockably engages the strap when the strap is inserted into the housing to secure the strap in a locked position. The housing has first and second opposed outer surfaces which taper outwardly and toward one another in a manner which makes the housing difficult to grasp manually or otherwise, thus helping prevent the breakage and removal of the device from the bottle. The tapered outer surfaces also serve to deflect impact forces to the housing to help prevent unauthorized removal of the device.

20 Claims, 7 Drawing Sheets

U.S. PATENT DOCUMENTS

| | | | | |
|---|---|---|---|---|
| 5,230,541 | A | 7/1993 | Nowak | |
| 5,337,503 | A | 8/1994 | Goby | |
| 5,377,510 | A | 1/1995 | Smith | |
| 5,398,383 | A | 3/1995 | Bingold | |
| 5,413,393 | A | 5/1995 | Georgopoulos et al. | |
| 5,437,172 | A | 8/1995 | Lamy et al. | |
| 5,524,463 | A | 6/1996 | Schenkel et al. | |
| 5,568,951 | A | 10/1996 | Morgan | |
| 5,602,530 | A | 2/1997 | Holmgren | |
| 5,791,079 | A | 8/1998 | Mazzucchelli | |
| 5,794,461 | A | 8/1998 | Smith | |
| 5,883,576 | A | 3/1999 | De La Huerga | |
| 5,969,613 | A | 10/1999 | Yeager et al. | |
| 6,044,669 | A | 4/2000 | Levi | |
| 6,098,256 | A | 8/2000 | Poussard | |
| 6,188,320 | B1 | 2/2001 | Kolton et al. | |
| 6,226,839 | B1 | 5/2001 | Sayegh | |
| 6,311,531 | B1 | 11/2001 | Sykes | |
| 6,326,890 | B1 | 12/2001 | Costa | |
| 6,523,228 | B1 | 2/2003 | Benoit | |
| 6,532,631 | B2 | 3/2003 | Rohaly et al. | |
| 6,631,629 | B1 | 10/2003 | Fuss et al. | |
| D506,694 | S | 6/2005 | Corney | |
| 7,032,415 | B2 | 4/2006 | Young | |
| 7,259,674 | B2 | 8/2007 | Marsilio et al. | |
| 7,266,979 | B2 | 9/2007 | Belden | |
| 7,397,375 | B2 * | 7/2008 | Marsilio et al. | 340/572.1 |
| 7,463,152 | B2 * | 12/2008 | Marsilio et al. | 340/572.1 |
| 7,486,190 | B2 * | 2/2009 | Marsilio et al. | 340/572.1 |
| 7,492,263 | B2 * | 2/2009 | Marsilio et al. | 340/572.1 |
| 7,492,264 | B2 * | 2/2009 | Marsilio et al. | 340/572.1 |
| 7,492,265 | B2 * | 2/2009 | Marsilio et al. | 340/572.1 |
| 7,498,944 | B2 * | 3/2009 | Marsilio et al. | 340/572.1 |
| 7,498,945 | B2 * | 3/2009 | Marsilio et al. | 340/572.1 |
| 7,602,297 | B2 * | 10/2009 | Marsilio et al. | 340/572.1 |
| 7,650,768 | B2 * | 1/2010 | Fawcett et al. | 70/58 |
| 2005/0211658 | A1 | 9/2005 | Bagration De Ulloa | |
| 2006/0048551 | A1 | 3/2006 | Tanos | |

* cited by examiner

BOTTLE SECURITY DEVICE

CROSS REFERENCE TO RELATED APPLICATIONS

This application claims priority from U.S. Non-Provisional patent application Ser. No. 11/436,730, filed May 17, 2006, which is a non-provisional patent application of U.S. Provisional Application Ser. No. 60/758,686 filed Jan. 13, 2006; the disclosures of which are incorporated herein by reference.

BACKGROUND OF THE INVENTION

1. Technical Field

The invention relates to anti-shoplifting devices, and more particularly to an anti-shoplifting device for merchandise having a substantially cylindrical surface and in particular, for bottles having a cylindrical neck. The invention provides a security device that holds an electronic article surveillance tag (EAS tag) which is concealed within a rigid housing which is secured by a ratchet strap around the neck of the bottle. The housing has opposed outer surfaces which are tapered toward one another to make it difficult to grasp the housing or otherwise force the housing to pry the device off of the bottle neck. The housing further includes an arcuate channel for receiving and guiding the strap within the housing.

2. Background Information

Many types of theft deterrent devices have been developed for protecting various types of merchandise. Many of these devices include EAS tags which are typically hidden from the potential thief and which will sound an alarm when removed from the store. Amongst these security devices are bottle security devices which are specifically configured to connect to the neck of a bottle in a manner that is difficult to remove without breaking the neck of the bottle.

In addition, various types of security devices utilize a ratchet-type strap which is secured around an object to prevent removal of the device from an item of merchandise. Many of these devices use a flat plastic strap which is either attached to or formed as part of the latching mechanism. However, many of these types of devices do not include a lock or contain an EAS tag. One of the problems that bottle security devices seek to overcome is the removal by a thief of the security device from the neck of a bottle. Attempts at such removal may involve manual manipulation of the device, gripping of the device with pliers or other like tools, prying with a screwdriver or the like and hitting the security device on a rigid structure such as a shelf or corner of a table in order to either break the device or pry it loose from the bottle neck. Thus, there is a need in the art to produce a bottle security device having a ratchet strap which is more difficult to remove from the bottle neck without breaking the bottle.

In addition, there is a need in the art to lock the ratchet strap to a housing to which it is attached in a simple and effective manner while providing a locking mechanism which may be easily unlocked by store personnel during the purchase of the bottle and contents thereof. The present invention addresses these and other problems.

BRIEF SUMMARY OF THE INVENTION

The present invention provides a security device which includes a housing and a strap which extends from the housing to loop around a bottle neck or other item to secure the device thereto. The housing has first and second opposed outer surfaces which taper outwardly and toward one another in a manner which makes the housing difficult to grasp manually, or otherwise, and which also serve to deflect impact forces to the housing to help prevent unauthorized removal of the device.

BRIEF DESCRIPTION OF THE SEVERAL VIEWS OF THE DRAWINGS

Similar numbers refer to similar parts throughout the drawings.

DETAILED DESCRIPTION OF THE INVENTION

Figure 1:
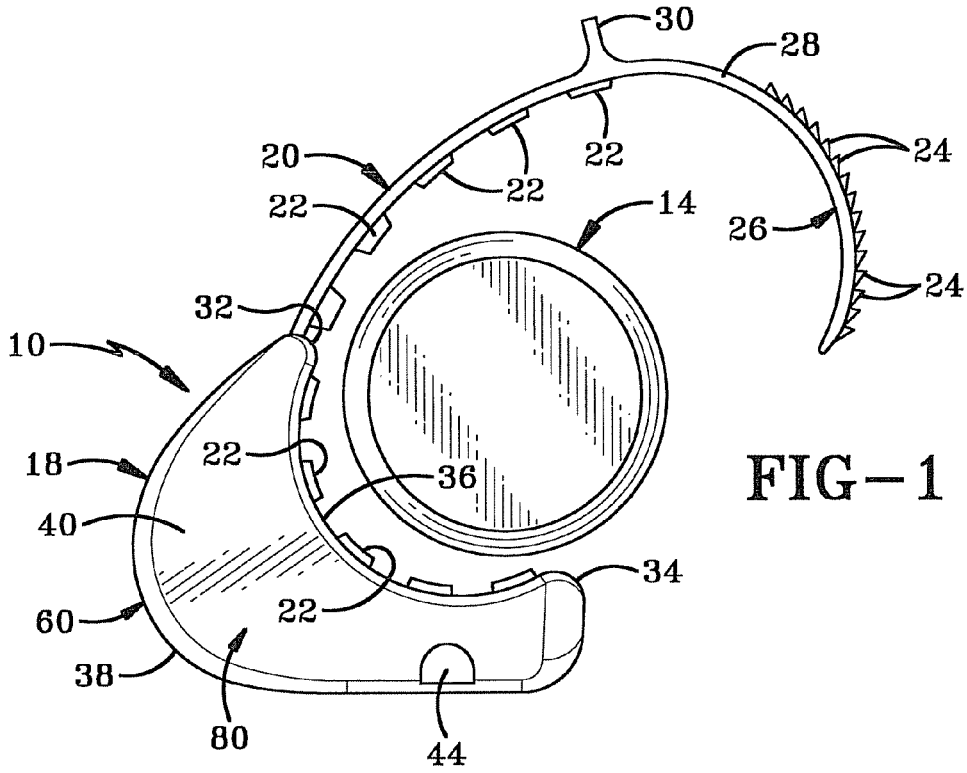
FIG. 1 is a top plan view of the bottle security device of the present invention in an unlocked position adjacent a neck of a bottle.
Figure 2:
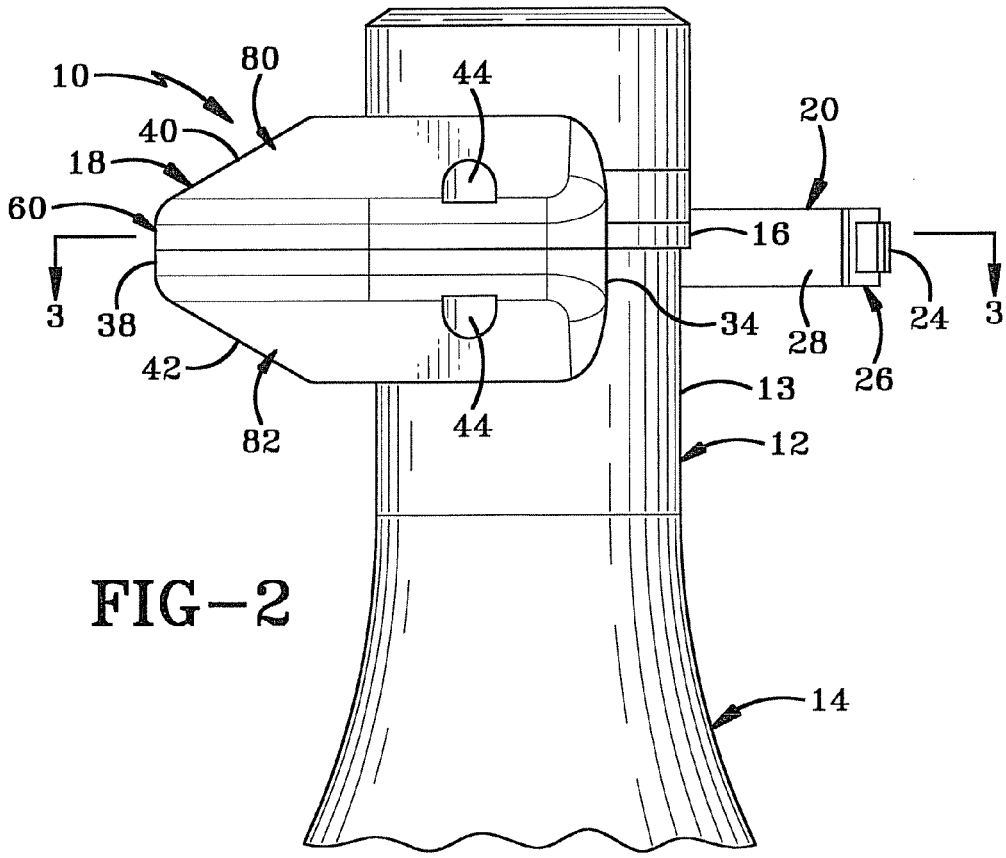
FIG. 2 is a side elevational view of the device and bottle neck shown in FIG. 1.

The bottle security device of the present invention is indicated generally at 10 in FIGS. 1 and 2, in which device 10 is shown in an unlocked position adjacent a substantially cylindrical neck 12 of a bottle 14. Neck 12 has an outer surface 13 and includes an outwardly projecting annular bead 16.

Device 10 includes a rigid housing 18 and a ratchet strap 20 which is connected to housing 18 and extends outwardly therefrom. Each of housing 18 and 20 has inwardly projecting tabs 22 which are circumferentially spaced from one another and are configured to contact a lower surface of bead 16 of neck 12 to prevent removal of device 10 from neck 12 when device 10 is locked thereon. Strap 20 is formed of a material having a sufficient stiffness to provide a preset curvature to the strap. Strap 20 is connected to housing 18 adjacent a first end thereof and includes a plurality of one way locking teeth 24 extending along a portion 26 of strap 20 adjacent a second opposed end thereof. Locking teeth 24 extend outwardly from a substantially flat body 28 of strap 20. A finger tab 30 also extends outwardly from body 28 to facilitate insertion of portion 26 of strap 20 into housing 18. Portion 26 of strap 20 is in the form of an arc which lies along a substantially circular path.

Housing 18 has first and second ends 32 and 34 which are circumferentially spaced from one another by a concave inner surface or perimeter 36 of housing 18 which is in the form of an arc which lies along a substantially circular path. Housing 18 has a convex outer perimeter 38 which is generally U-shaped and extends from first end 32 to second end 34 of housing 18. Housing 18 includes first and second opposed outer anti-grasping or deflecting surfaces 40 and 42 which taper outwardly from adjacent inner perimeter 36 toward one another to closely adjacent inner perimeter 36. Surfaces 40 and 42 are preferably smooth and slippery to help prevent manual or other grasping thereof. For purposes of description herein, outer surface 40 may be considered an upper surface and outer surface 42 may be considered a lower surface. Upper surface 40 tapers outwardly and downwardly from adjacent inner perimeter 36 to adjacent outer perimeter 38 and lower surface 42 tapers outwardly and upwardly from adjacent inner perimeter 36 to adjacent outer perimeter 38. Each of surfaces 40 and 42 extend circumferentially from adjacent first end 32 to adjacent second end 34 of housing 18. Each of surfaces 40 and 42 are generally frustoconical while varying somewhat from a true frustoconical shape in light of the U-shaped outer perimeter 38 of housing 18. Housing 18 further defines a pair of spaced key alignment indentations 44 which respectively extend inwardly from surfaces 40 and 42. Indentations 44 are utilized to align a magnetic key such as that shown and described in co-pending patent application having Ser. No. 11/022,084, the contents of which are incorporated herein by reference. Said application also shows and describes a locking mechanism similar to that of the present invention.

Figure 3:
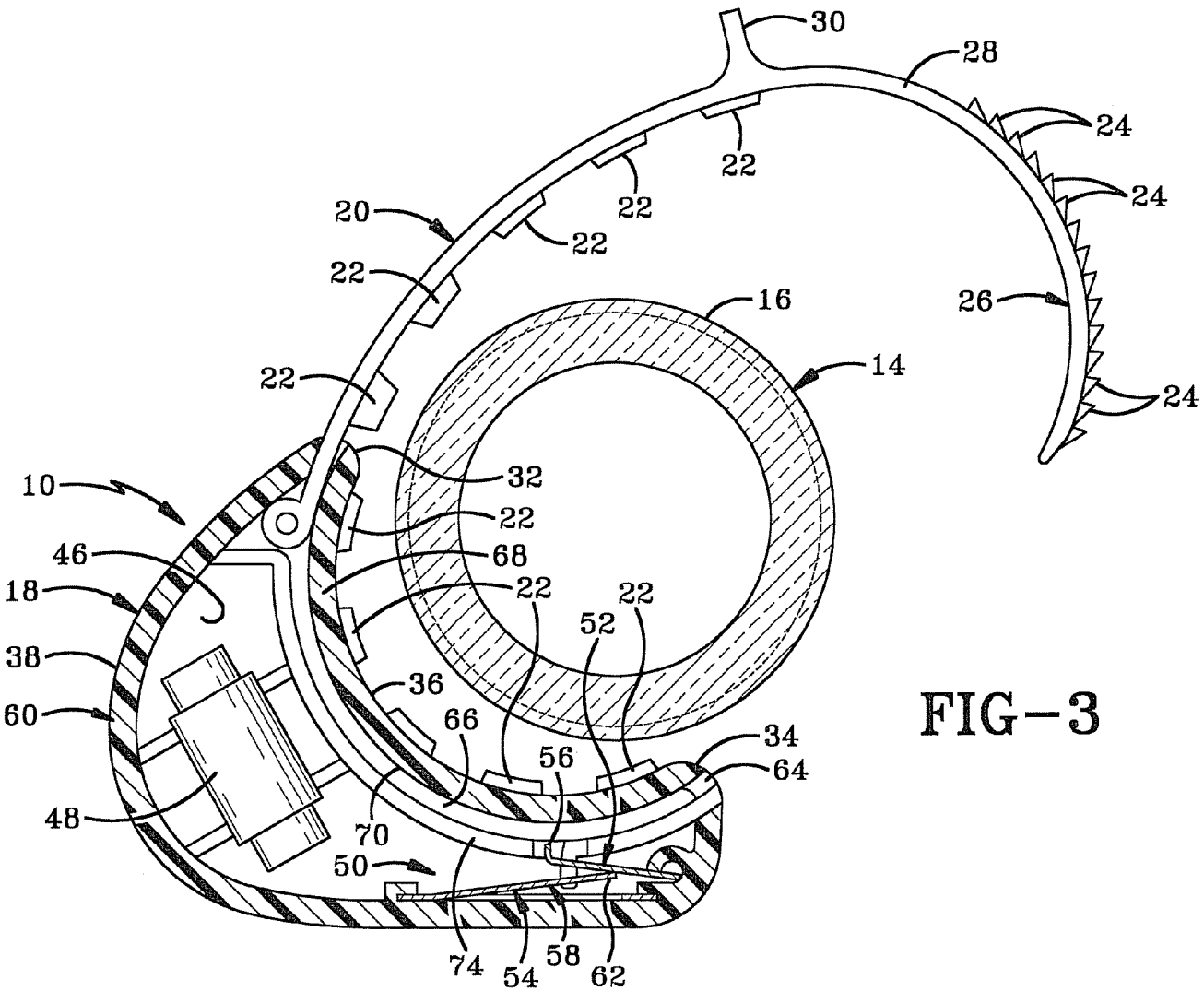
FIG. 3 is a sectional view taken on line 3-3 of FIG. 2 showing the internal structure of the housing of the security device.

With reference to FIG. 3, housing 18 defines an interior chamber 46 which serves to house an EAS tag 48 and a locking mechanism 50 which lockably engages locking teeth 24 of strap 20 when strap 20 is in a locked position to prevent removal of strap 20 from housing 18 and to secure device 10 to bottle neck 12. Locking mechanism 50 includes a locking pawl 52 and a spring biased actuation strip 54 which biases locking pawl 52 to a locked position shown in FIG. 3. Locking pawl 52 is formed of a metal, is pivotally mounted within interior chamber 46 and has a bent free end 56 which lockably engages locking teeth 24 when strap 20 is in a locked position. Actuation strip 54 is formed of a spring metal and includes a spring finger 58 which is cantilevered from adjacent an outer wall 60 of housing 18 and includes a free end 62 which engages locking pawl 52 to spring bias locking pawl 52 into its locked position. Housing 18 defines an entry port 64 adjacent second end 34 thereof for receiving the free end of strap 20. Free end 56 of locking pawl 52 extends generally away from entry port 64 and free end 62 of locking finger 58 extends generally toward entry port 64.

Housing 18 defines an arcuate channel 66 which communicates with entry port 64 and is configured to receive portion 26 of strap 20. Channel 66 has an arcuate path which is complimentary to the arcuate shape of portion 26 of strap 20 to facilitate the insertion and removal of portion 26 into and out of channel 66. More particularly, channel 66 is an arc which lies along a substantially circular path. Channel 66 is bounded by an arcuate inner wall 68 of housing 18. More particularly, inner wall 68 has a convex arcuate surface 70 which bounds channel 66 opposite of inner perimeter 36 of housing 18. Channel 66 extends from entry port 64 to adjacent the first end of strap 20 which is disposed within interior chamber 46 adjacent first end 32 of housing 18. Channel 66 is described in greater detail further below.

Figure 4:
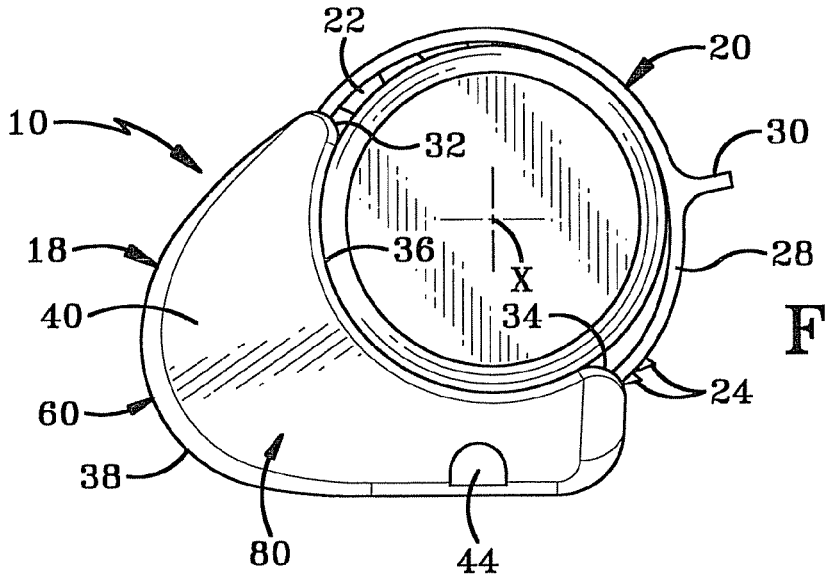
FIG. 4 is similar to FIG. 1 and shows the security device in a locked position on the bottle neck.
Figure 5:
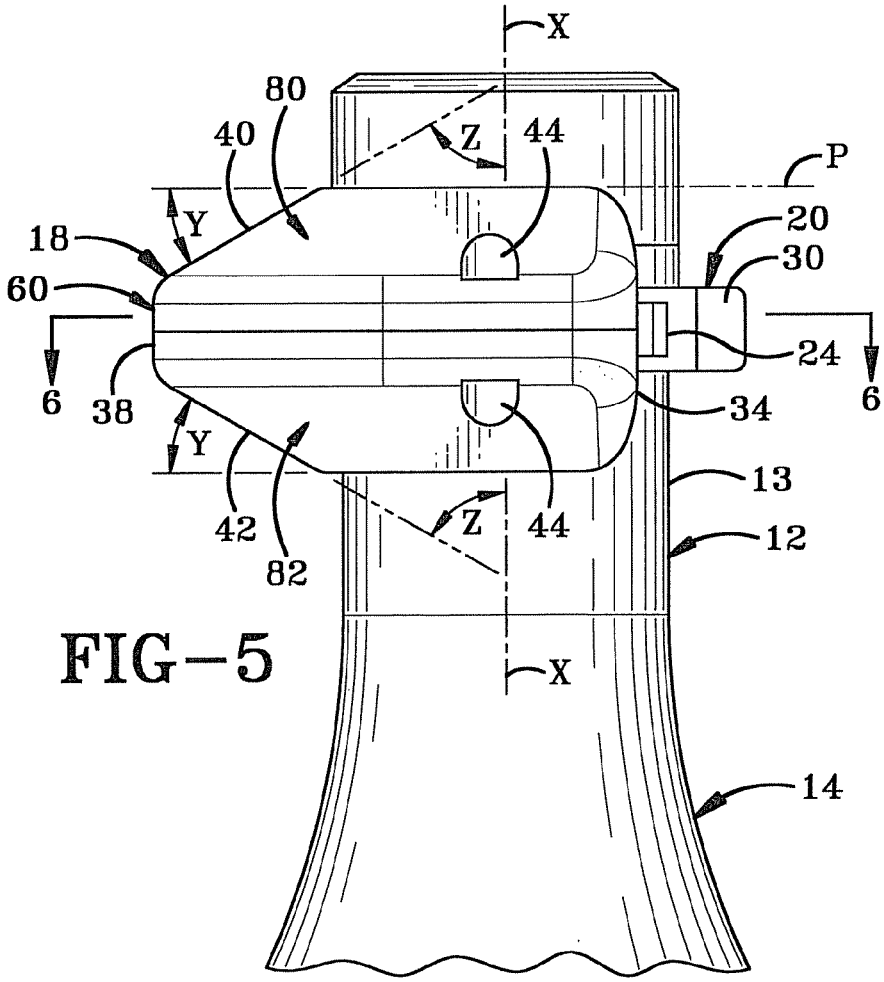
FIG. 5 is similar to FIG. 2 and shows the security device locked on the bottle neck.
Figure 6:
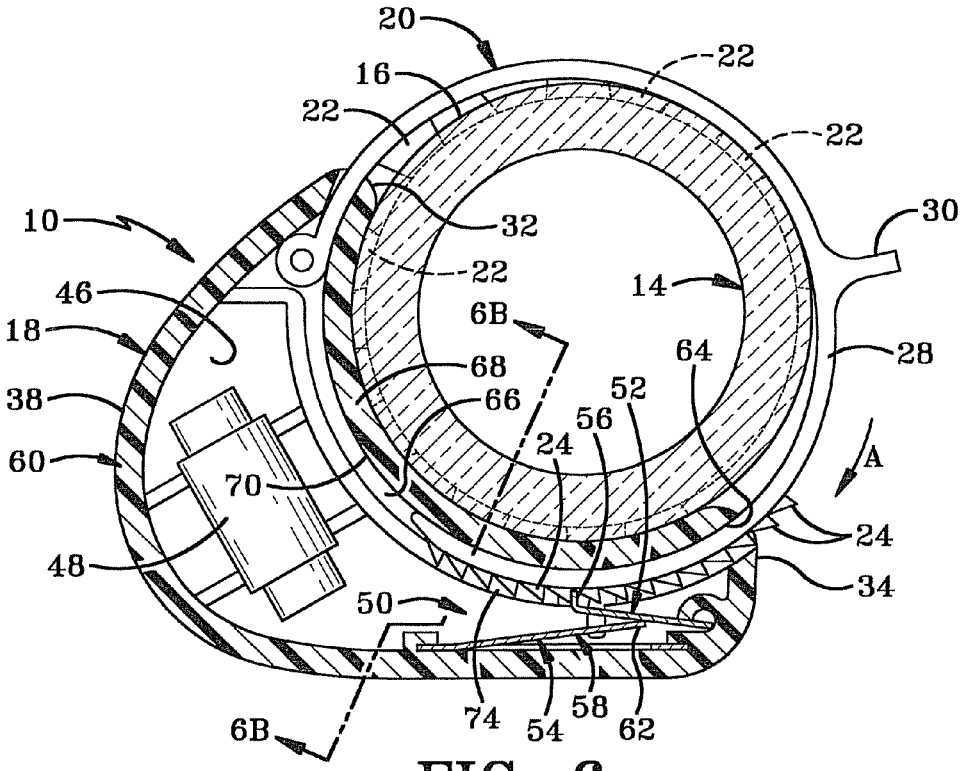
FIG. 6 is a sectional view taken on line 6-6 of FIG. 5.

FIGS. 4-6 show device 10 in the locked position in which it is lockably secured to bottle neck 12 with tabs 34 disposed below bead 16. In the locked position of device 10, inner perimeter 36 is in contact with the outer surface of neck 12, in particular in contact with bead 16. Thus, when locked onto bottle 14, anti-grasping surfaces 40 and 42 taper outwardly toward one another from closely adjacent neck 12, thus providing a minimal amount of surface which may be easily grasped in an attempt to force device 10 off of bottle neck 12. To move from the unlocked to the locked position of device 10, strap 20 is inserted as shown at Arrow A in FIG. 6 through entry port 64 and into arcuate channel 66 so that bent free end 56 of locking pawl 52 lockably engages one of locking teeth 24 of strap 20. In the locked position, strap 20 cannot be removed from housing 18 without the appropriate key and device 10 is securely attached to bottle neck 12. Should a potential thief move bottle 14 and device 10 to an unauthorized area, EAS tag 48 will cause an audible alarm to sound to warn store personnel of the potential theft.

As shown in FIGS. 4 and 5, bottle neck 12 is substantially concentric about a longitudinal axis X which passes centrally through bottle 14 and is substantially vertical when bottle 14 is in an upright position as shown in FIG. 5. Outer surface 13 of bottle neck 12 is substantially parallel to axis X. When device 10 is locked onto bottle neck 12 as shown in FIGS. 4 and 5, inner wall 68 of housing 18 and strap 20 form a substantially circular configuration which is substantially concentric about axis X. Strap 20 and housing 18 are spaced radially outwardly of axis X and disposed substantially along a plane P which is perpendicular to axis X. Upper tapered surface 40 of housing 18 is angled with respect to plane P as indicate at angle Y and with respect to axis X as indicated at angle Z. Typically, lower tapered surface 42 has the same respective angles Y and Z as indicated in FIG. 5 although this may vary somewhat. The lines in FIG. 4 which are numbered as surfaces 40 and 42 represent respective linear intersections with a plane in which the axis X lies.

It is noted that the angle of surfaces 40 and 42 with respect to such a perpendicular plane as plane P may vary as one moves circumferentially along said surfaces 40 and 42. Thus, for instance, the angle of surface 40 with respect to plane P adjacent second end 34 of housing 18 may be different than the angle represented at Y in FIG. 5, which is along surface 40 intermediate first and second ends 32 and 34 of housing 18. Each of surfaces 40 and 42 thus may represent a variable angle surface as one travels circumferentially around housing 18. Having said this, angle Y and corresponding angles with respect to a plane such as plane P needs to be sufficiently large to provide the anti-grasping end and other characteristics described further below. In the exemplary embodiment, angle Y is approximately 30° and angle Z is approximately 60°. However, these angles may vary. Angle Y is typically at least 25°, more preferably at least 30°. In general, the greater that angle Y is, the more effective surfaces 40 and 42 may be in creating anti-grasping characteristics and other characteristics subsequently described herein. However, it is preferred to keep angle Y as small as possible while producing these desired characteristics in order to produce a housing 18 which has a size which is as small as possible for the purpose.

Figure 6A:
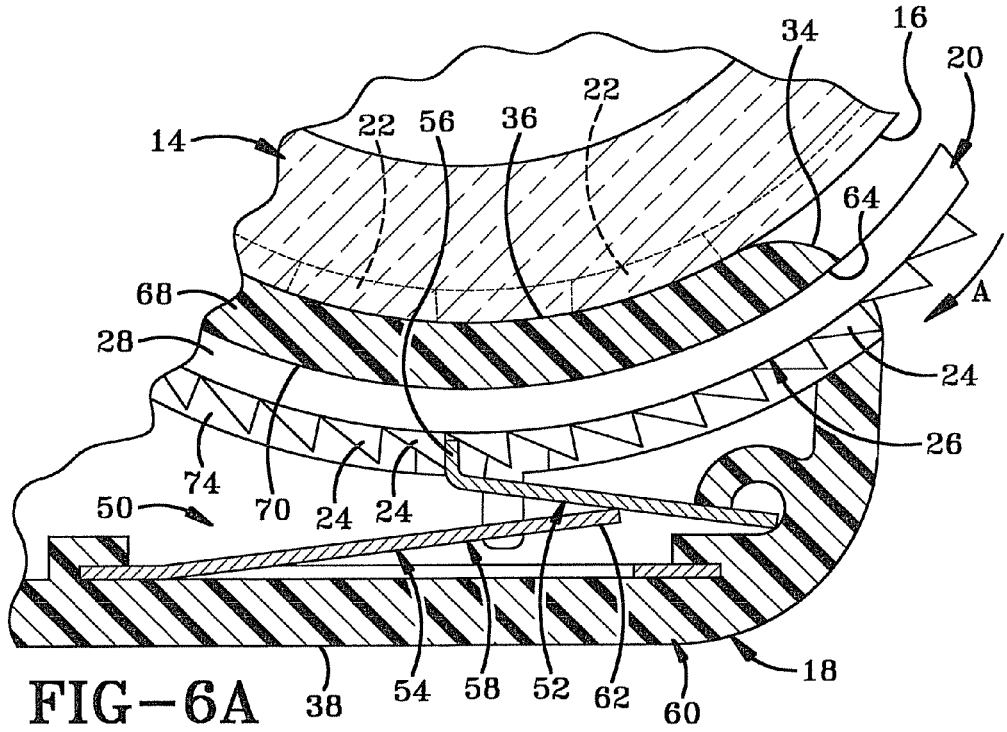
FIG. 6A is an enlarged fragmentary sectional view of a portion of FIG. 6 showing the locking mechanism in greater detail.
Figure 6B:
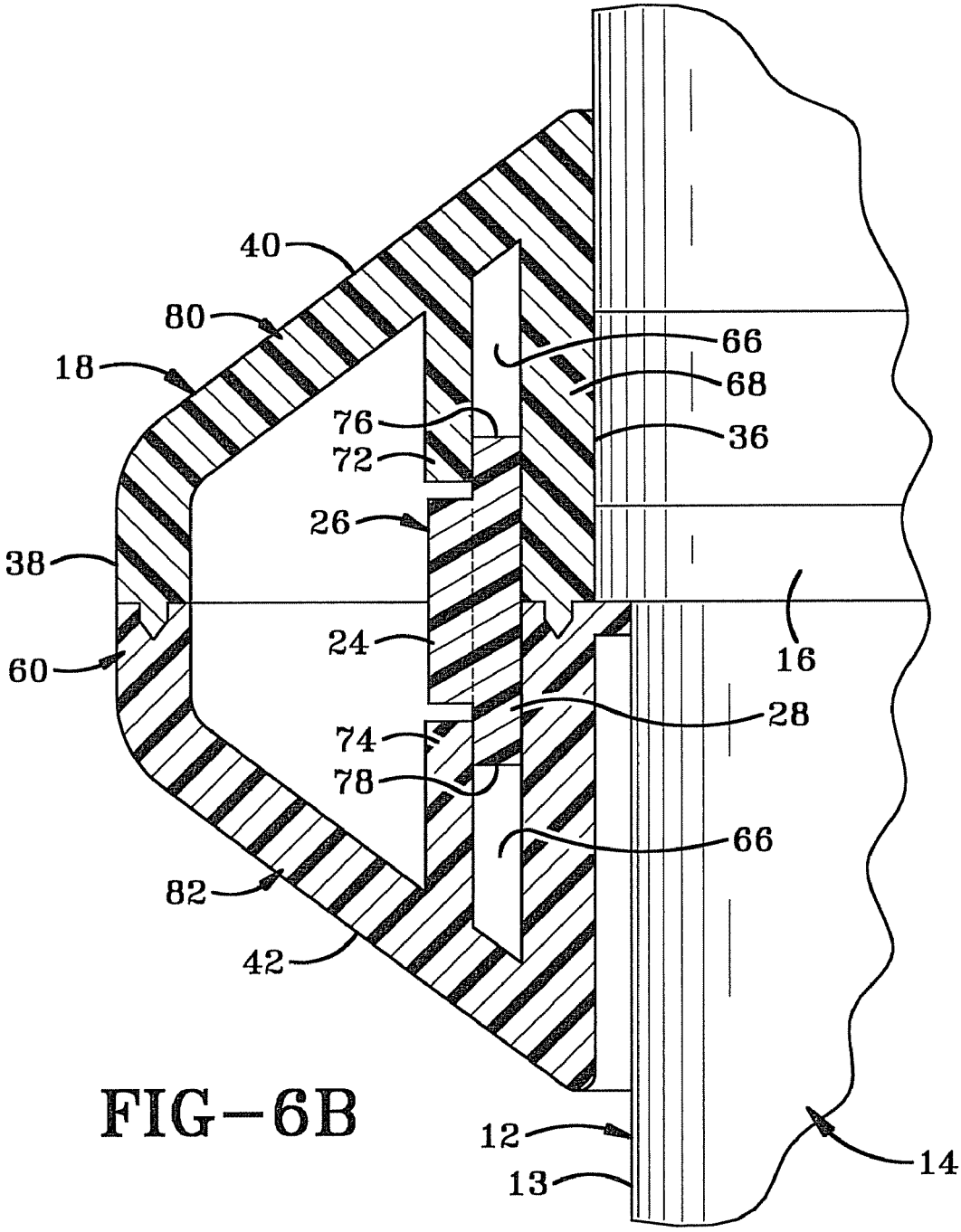
FIG. 6B is a sectional view taken on line 6B-6B of FIG. 6.

With reference to FIG. 6B, arcuate channel 66 is further detailed. Channel 66 has a T-shaped cross-sectional configuration as does strap 20 along portion 26 thereof. More particularly, a pair of opposed intermediate walls 72 and 74 are disposed within interior chamber 46 of housing 18 and are substantially parallel to inner and outer walls 68 and 60 of housing 18. Walls 72 and 74 are spaced outwardly from inner wall 68 a distance which is slightly larger than the thickness of body 28 of strap 20 so that the inner surface of strap 20 along portion 26 thereof abuts the outer surface of inner wall 68 when in a locked position and the outer surface of portion 26 adjacent first and second opposed edges 76 and 78 thereof is respectively closely adjacent or in abutment with walls 72 and 74. Each of walls 72 and 74 is arcuate and more particularly is an arc lying along a circular path. Walls 72 and 74 are respectively cantilevered from upper and lower tapered walls 80 and 82 of housing 18. The free ends of walls 72 and 74 extend toward one another and define therebetween a portion of slot 66 in which locking teeth 24 are disposed when in the locked position. Bent free end 56 of locking pawl 52 extends into this portion of slot 66 in its locked position, as shown in FIG. 6A.

Arcuate channel 66 has a curvature which mates with that of portion 26 of strap 20 to facilitate easy insertion and withdrawal of strap 20. Channel 66 also positions portion 26 of strap 20 more precisely than in known prior art devices to accurately align locking teeth 24 with bent free end 56 of locking pawl 52. This greater precision of positioning and alignment allows strap 20 to perform more effectively than in known prior art devices while allowing for a loosening of tolerances in the manufacture of strap 20, especially in portion 26 thereof. This reduction in tolerance requirements allows for less expensive manufacture of strap 20 in particular.

Figure 7:
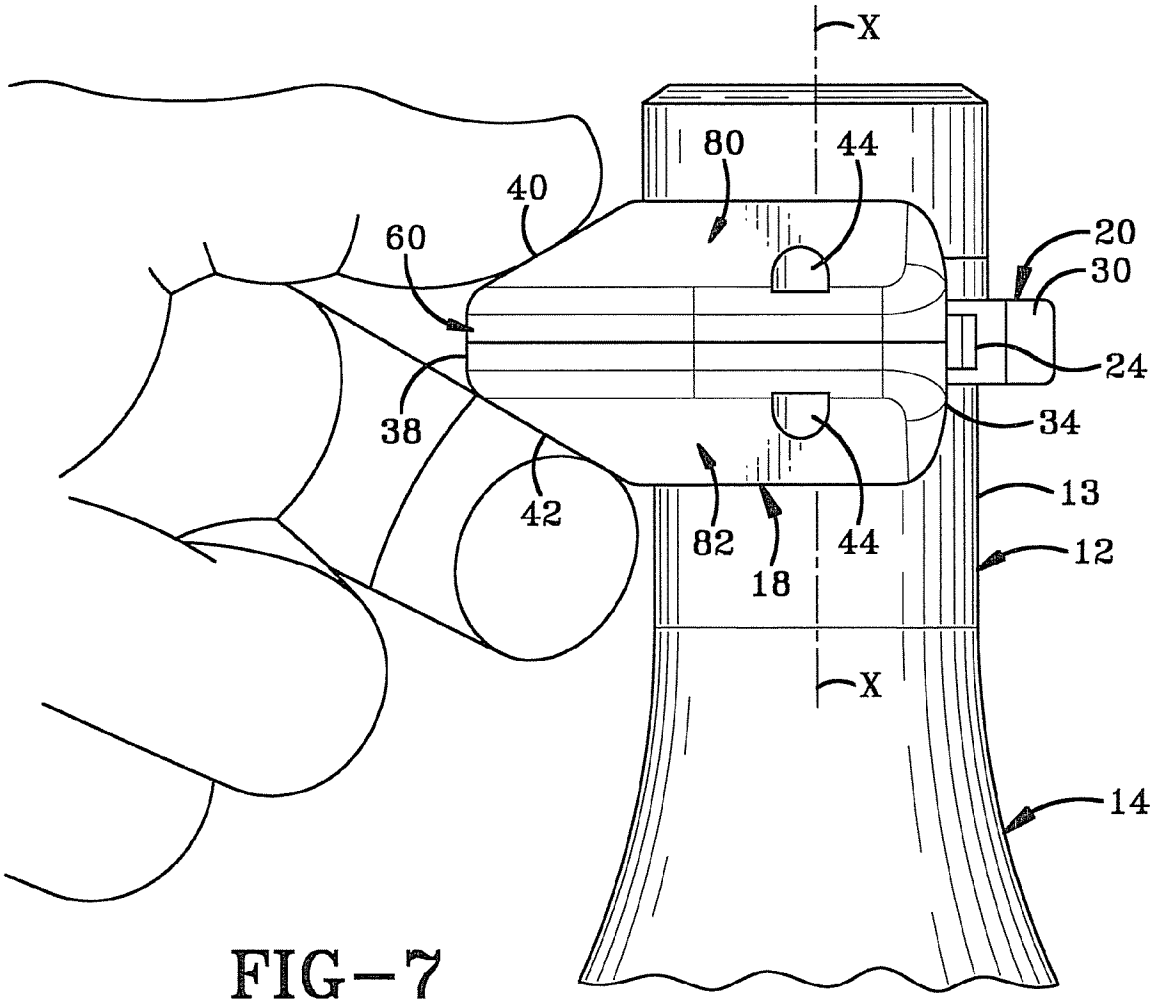
FIG. 7 is a view similar to FIG. 5 showing a hand with fingers in contact with the anti-grasping surfaces of the housing.
Figure 8:
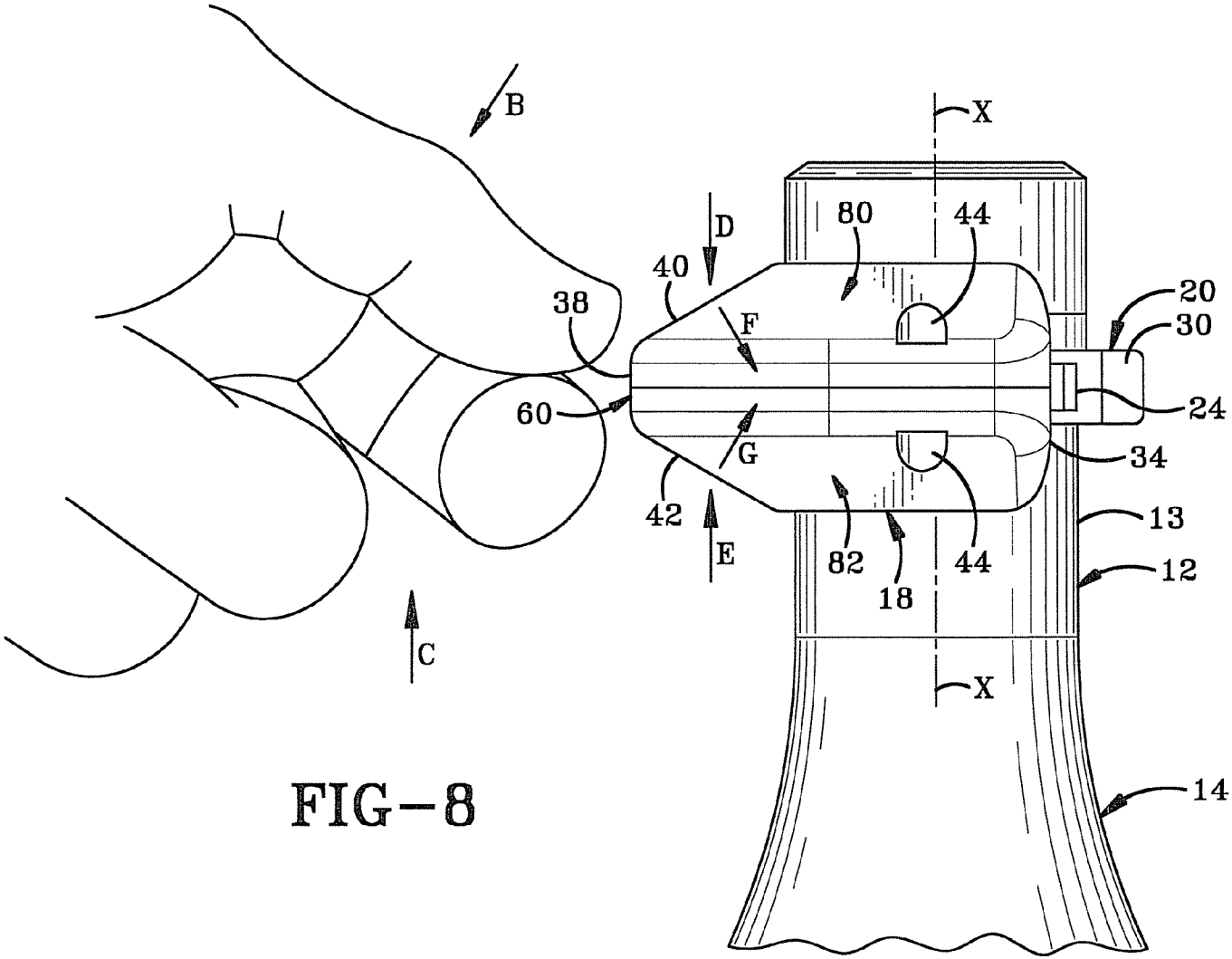
FIG. 8 is similar to FIG. 7 and shows the fingers of the hand having slipped off of the anti-grasping surfaces.

Once device 10 is locked onto bottle neck 12 as shown in FIGS. 7 and 8, anti-grasping surfaces 40 and 42 make it more difficult to grasp housing 18 in a manner which would promote the prying or breaking of housing 18 from strap 20 in order to remove device 10 from bottle neck 12. For instance, FIG. 7 shows a hand with a thumb and finger respectively in contact with outer surfaces 40 and 42 in an effort to grasp housing 18 to break housing 18, strap 20 or the connection therebetween in order to remove device 10 from bottle neck 12. However, the tapered nature of surfaces 40 and 42 tends to make the thumb and finger slide off of housing 18 as shown respectively at Arrows B and C in FIG. 8. In the known prior art devices which utilize a ratchet strap and housing, the housing typically provides an upper and/or lower surface which is substantially perpendicular to axis X, thus providing surfaces which are easily grasped manually and which are easily impacted by forces substantially parallel to axis X, as indicated at Arrows D and E in FIG. 8, which have been found to sometimes defeat such typical prior art devices. By contrast, tapered surfaces 40 and 42 of housing 18 tend to deflect such forces and reduce their effectiveness in compromising the integrity of device 10 so that device 10 remains secured to bottle neck 12. Thus, when a potential thief moves bottle 14 in a direction indicated at Arrow E in order to impact surface 40 on a structure such as a shelf, table or the like to create a force represented by Arrow D on surface 40, the tapered nature of surface 40 deflects the impact and thus reduces the amount of force applied in the direction of Arrow D by changing the force vector to angle inwardly towards bottle neck 12 as represented generally at Arrow F. Similarly, a force applied to surface 42 as indicated along a force vector indicated at Arrow E will similarly be deflected to a force vector indicated at Arrow G. In short, housing 18 of device 10 is configured to make it more difficult to break device 10 off of bottle neck 12 without breaking bottle neck 12.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A security device for attaching around a generally annular article to be protected from theft, said device comprising:

a rigid housing having first and second opposed ends, an inner perimeter, an outer perimeter, and upper and lower opposed outer surfaces each extending from adjacent the inner perimeter to adjacent the outer perimeter and from adjacent the first end to adjacent the second end;

an interior chamber formed in the housing with an entry port;

a strap secured to and extending outwardly from the housing; and a locking mechanism disposed in the interior chamber for lockably engaging the strap when the strap is inserted through the entry port to secure the strap in a locked position in which the strap and inner perimeter of the housing define therebetween an article-receiving space adapted to receive the generally annular article and in which the strap and inner perimeter of the housing together assume a generally circular configuration which is generally concentric about a vertical axis; and wherein the upper outer surface tapers radially outwardly and downwardly relative to the vertical axis from adjacent the inner perimeter to adjacent the outer perimeter and the lower outer surface tapers radially outwardly and upwardly relative to the vertical axis from adjacent the inner perimeter to adjacent the outer perimeter so that the upper and lower outer surfaces taper radially outwardly and toward one another from adjacent the inner perimeter to adjacent the outer perimeter; and each of the tapered outer surfaces and a plane perpendicular to the vertical axis defines therebetween an angle of at least 25 degrees.

2. The device of claim 1 wherein each angle is within a range of 25 to 60 degrees.

3. The device of claim 1 wherein the outer surfaces extend circumferentially in a continuous manner from adjacent the first end to adjacent the second end.

4. The device of claim 3 wherein each of the tapered outer surfaces is smooth.

5. The device of claim 1 wherein each of the inner and outer perimeters extend from adjacent the first end to adjacent the second end.

6. The device of claim 1 wherein each of the tapered outer surfaces is circumferentially curved in a continuous manner along a horizontal path from adjacent the first end to adjacent the second.

7. The device of claim 1 wherein the inner perimeter defines an arc of a circle which is concentric about the vertical axis and extends from adjacent the first end to adjacent the second end.

8. The device of claim 1 wherein each of the tapered outer surfaces is generally frustoconical.

9. The device of claim 1 wherein the inner perimeter forms an arc of at least one fourth of a circle which is concentric about the vertical axis.

10. The device of claim 9 wherein the inner perimeter forms an arc of at least one third of a circle which is concentric about the vertical axis.

11. The device of claim 1 wherein the outer perimeter is a convex U-shaped curve which extends continuously from adjacent the first end to adjacent the second end.

12. The device of claim 1 wherein the housing defines an arcuate channel communicating with the entry port for receiving the strap; and wherein the arcuate channel is curved along an arc of a substantially circular pathway which is substantially concentric about the vertical axis.

13. The device of claim 12 wherein the strap has a preset curvature whereby the strap prior to insertion through the entry port into the arcuate channel assumes an arc which is of mating configuration with the arc of the arcuate channel.

14. The device of claim 1 in combination with the generally annular article; and wherein in the locked position the strap loops horizontally around the generally annular article and substantially concentrically around the vertical axis; a portion of the article is disposed within the loop and the article extends upwardly beyond the loop and downwardly beyond the loop; the upper outer surface tapers radially outwardly and downwardly from adjacent the article to adjacent the outer perimeter; and the lower outer surface tapers radially outwardly and upwardly from adjacent the article to adjacent the outer perimeter.

15. The combination of claim 14 wherein the generally annular article is a bottle having a neck which the strap loops around.

16. The combination of claim 15 wherein the neck of the bottle is circular; and the inner perimeter defines an arc of a circle which mates with the circular neck of the bottle.

17. The combination of claim 14 wherein the inner perimeter abuts the article and forms an arc of at least one fourth of a circle which is concentric about the vertical axis.

18. The combination of claim 17 wherein the inner perimeter forms an arc of at least one third of a circle which is concentric about the vertical axis.

19. The device of claim 14 wherein the outer perimeter is a convex U-shaped curve which extends continuously from adjacent the first end to adjacent the second end.

20. A security device for attaching around a generally annular article to be protected from theft, said device comprising:

a rigid housing having first and second circumferentially opposed ends, a concave inner perimeter, an outer perimeter, and upper and lower opposed outer surfaces each extending from adjacent the inner perimeter to adjacent the outer perimeter;

an interior chamber formed in the housing with an entry port;

a strap secured to and extending outwardly from the housing;

a locking mechanism disposed in the interior chamber for lockably engaging the strap when the strap is inserted through the entry port to secure the strap in a locked position in which the strap and inner perimeter of the housing define therebetween an article-receiving space adapted to receive the generally annular article and in which the strap and inner perimeter of the housing together assume a generally circular configuration which is generally concentric about a vertical axis; and wherein the upper outer surface tapers radially outwardly and downwardly relative to the vertical axis from adjacent the inner perimeter to adjacent the outer perimeter and the lower outer surface tapers radially outwardly and upwardly relative to the vertical axis from adjacent the inner perimeter to adjacent the outer perimeter so that the first and second opposed outer surfaces taper radially outwardly and toward one another from adjacent the inner perimeter to adjacent the outer perimeter;

each of the tapered outer surfaces extends circumferentially from adjacent the first end to adjacent the second end and defines a respective substantially linear intersection with a vertical plane in which the vertical axis lies;

each linear intersection is disposed centrally between the opposed ends and extends from adjacent the inner perimeter to adjacent the outer perimeter; and each linear intersection and a plane perpendicular to the vertical axis defines therebetween an angle of at least 25 degrees.

* * * * *